United States Patent [19]

Klomp

[11] 4,390,097

[45] Jun. 28, 1983

[54] PACKAGED ELECTRIC LAMP

[75] Inventor: Franciscus M. Klomp, Eindhoven, Netherlands

[73] Assignee: U.S. Philips Corporation, New York, N.Y.

[21] Appl. No.: 270,665

[22] Filed: Jun. 4, 1981

[30] Foreign Application Priority Data

Jul. 14, 1980 [NL] Netherlands ..... 8004029

[51] Int. Cl.[3] ..... B65D 85/42

[52] U.S. Cl. ..... 206/418; 206/419

[58] Field of Search ..... 206/45.14, 45.19, 45.31, 206/418, 419, 420, 422, 485; 229/39 B, 29 F

[56] References Cited

U.S. PATENT DOCUMENTS 3,144,131 8/1964 Pitt et al. ..... 206/419
3,157,275 11/1964 Tolaas ..... 206/45.14
4,194,623 3/1980 Klomp et al. ..... 206/418

FOREIGN PATENT DOCUMENTS 702024 1/1954 United Kingdom ..... 206/418

*Primary Examiner*—William T. Dixson, Jr.
*Assistant Examiner*—Brenda J. Ehrhardt
*Attorney, Agent, or Firm*—Thomas A. Briody; William J. Streeter; Rolf E. Schneider

[57] ABSTRACT

There is provided an electric lamp package comprising a lamp envelope connected at one end to a lamp cap, and an elongate packaging strip folded along parallel transversal first fold lines to form a bottom wall, a front wall, and a rear wall for accommodating the lamp with its lamp cap remote from the bottom wall. The front wall and the rear wall extend above the lamp cap and engage each other. A window is provided in the front wall for displaying at least part of the lamp cap and a part of the lamp envelope, the boundary of the window engaging the lamp to hold the same in place. A pair of lengthwise incisions are formed in the rear wall and extend beyond the lamp cap to provide two edge portions in opposite lateral edge-wise contact with the lamp envelope, the respective edge portions being secured to the front wall.

9 Claims, 18 Drawing Figures

PACKAGED ELECTRIC LAMP

Figure 1A:
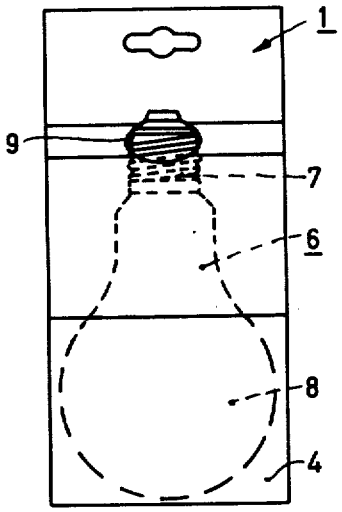
PRIOR ART FIG. 1a

This invention relates to a packaged electric lamp having a lamp envelope which has a lamp base on cap at one end, the package being formed from an elongate strip of packaging material, which is folded along parallel transversal first fold lines so as to form a bottom wall, a front wall and a rear wall for the package, in which the lamp is accommodated with its lamp cap remote from the bottom wall, and the front wall of which has a window which displays at least a part of the lamp cap and holds the lamp with its edges, the front wall and the rear wall extending above the lamp cap, engaging each other, and being connected together near the lamp cap.

Such a packaged electric lamp is disclosed in Canadian Pat. 711,601. In the patented construction, the bottom of the lamp cap projects through the window in the front wall and the sole object of the window is to fix the lamp in the package with the window edges engaging the lamp cap. Therefore the window is small and displays only a small part of the lamp cap. The inner surface of the strip is entirely coated with a layer of adhesive which, in the places where the lamp envelope is in contact with said layer, ensures an adhesion of the lamp envelope to the package and hence a secure fixing of the lamp in the package.

Disadvantages of the known packaged lamp are that the lamp can easily be removed from the package without the package being destroyed and also that the sticky layer causes soiling of the lamp. A further disadvantage is that the package, viewed from the front, does not provide information on the type of the packaged lamp.

For electric lamps, there is a great variety of types available, each type having its individual application. With the advent of self-service shops, the purchaser himself has to try to find the required lamp from the stock on display. He must rely mostly on the information printed on the lamp packages. In practice it has been found that even when written information is illustrated with a pictogram, this may be insufficiently clear to prevent the purchaser from opening the package to inspect the contents.

In order to give sufficient information about the nature of the packaged lamp: the shape and the size of the lamp cap, the shape and the finish of the lamp envelope, for example, frosting, coating, mirroring and colour, lamps are sometimes packaged between a cardboard shield and a transparent synthetic foil shrunk around the lamp, or in a box of a transparent synthetic resin material. The high cost-price of such packages and the environmental pollution caused by disposal of used packages, however, constitute serious disadvantages thereof. In addition, said packages are often not suitable to be displayed either in a suspended or in a standing position.

It is the object of the present invention to provide a packaged electric lamp which avoids the disadvantages of known packaged lamps. A particular object of the invention is to provide a packaged electric lamp which both in a standing position and in a position suspended from a wall, when viewed from the front allows good visibility of the lamp itself but which nevertheless keeps the lamp adequately fixed in the package.

According to the invention, this object is achieved in that the window in the front wall extends along the lamp envelope towards the bottom wall of the package, and that respective incisions extending substantially in the longitudinal direction of the strip are provided in the rear wall on both sides of the lamp so as to extend beyond the lamp cap, so that respective edge portions are formed in the rear wall on either side of the lamp which edge portions extend obliquely over the lamp envelope in opposite lateral edge-wise contact therewith towards the front wall and are connected thereto.

The packaged lamp can be obtained in a simple manner by folding the blank strip of packaging material provided with window, incisions and foldlines about the lamp, moving the front and rear walls towards each other and connecting the front and rear walls together in two places on either side of the lamp. The connection may be done by means of staples or an adhesive. If desired, the front and rear walls may be connected together in more than two places. When an adhesive is used, the front and rear walls may be adhesively secured together over the whole surface where they touch each other. When the front and rear walls are connected together only locally, the rigidity of the strip influences the place for the connection. For a strip of low rigidity the points of connection are chosen to be as close as possible to the bottom wall of the package, while in the case of a strip of high rigidity the points of connection may be situated more laterally of the lamp cap.

The packaging material may be selected inter alia from mini-corrugated cardboard, duplex paperboard and triplex paperboard, in which case material having a weight of, for example, 250–450 g/m$^2$ may be used.

Like the packaged lamp of the aforementioned Canadian patent, the packaged lamp according to the invention is substantially fully visible from the sides. In addition, due to the presence of the window, however, the packaged lamp according to the invention can be observed from the front for all external characteristic features which are needed for selection of a lamp. That the front of the package affords this possibility is of importance because in electric lamps the operating voltage, the power and possibly the width of the radiated light beam are not external characteristics of the lamp but have to be given as printed information. In contrast with the side of the packaged lamp, it is just the front of the package which can be used for this purpose, as well as for an indication of the brand name of the product. In the packaged lamp according to the invention all necessary information regarding the lamp is given by the lamp itself and in a printed form on the front of the package. This is also of importance because the packaged lamp can alternatively be displayed in a suspended position between other lamps, all other information being observable from the front, although adjacent lamps may restrict the view from the sides of the packaged lamp.

In the packaged electric lamp according to the invention the lamp envelope and sometimes also the lamp cap, project beyond the front wall of the package. In spite of this, drop tests have demonstrated that the packaged lamp satisfies the necessary packaging standards when packaged in the shipment package. As will become apparent, a central portion is present in the rear wall of the package between the edge portions, which central portion extends along the lamp envelope and the lamp cap. Said central portion forms a shock absorber between two adjacent packaged lamps in a shipment package and prevents contact of said lamps.

Lamps in a variety of shapes can be packaged according to the invention.

In the front wall of the package a second fold line may be present below the lamp cap parallel to the first fold lines, about which second fold line the front wall is bent concavely so that the front wall of the package has a concave surface. In this manner the bottom wall can be given a larger dimension and hence the packaged lamp can be given greater stability while in a standing position.

In lamp having a lamp envelope the largest transverse dimension of which is situated nearer to the end of the lamp opposite the lamp cap, such a second fold line provided between said largest transverse dimension and the lamp cap has the advantage that the edge portions of the rear wall remain farther remote from the lamp cap so that an even better fixing of the lamp in the package is obtained.

In a further preferred embodiment of a packaged lamp in which the largest transverse dimension is situated nearer to the end of the lamp opposite the lamp cap, in which a second fold line in the front wall may or may not be present, the front wall is bent convexly about a third fold line, parallel to the first fold lines, near the largest transverse dimension of the lamp envelope. Therefore, the front wall extends from said fold line more towards the rear to the bottom wall. The advantage of this shape is that the packaged lamp occupies less space and requires less packaging material. Furthermore, an extra support against the front wall can thus be given to the lamp.

In another preferred embodiment of a packaged lamp in which the largest transverse dimension of the lamp envelope is situated nearer to the end of the lamp opposite the lamp cap, which preferred embodiment may or may not be combined with a preceding one, the rear wall is bent convexly about a third fold line parallel to the first fold line, near the largest transverse dimension of the lamp envelope. This embodiment has advantages corresponding to those of the embodiment having a third fold line in the front wall.

The package which has a third fold line both in the front wall and the rear wall may be proportioned so that the lamp does not touch the bottom wall of the package so that the bottom wall has a greater shock absorbing effect.

Such a greater shock absorbing effect is also afforded by a strip in which the bottom wall has a fourth fold line near one of the first fold lines and parallel thereto, about which fourth fold line the bottom wall is bent concavely and in which the bottom wall portion between the fourth fold line and the adjacent first fold line is connected to the wall present on the other side of said first fold line. In addition to the shock absorbing effect, this embodiment and the embodiment described in the preceding paragraph permit tolerances in the dimensions, particularly the length, of the lamp to be compensated for without causing the standing face of the packaged lamp to become uneven. When, due to too large a length, the lamp indents the bottom wall of the strip, in the last-mentioned embodiment this has no influence on the stability of the standing packaged lamp as long as the bottom wall only touches the supporting surface, for example a table, along the first fold lines. In the penultimate embodiment a larger lamp length does not result in the lamp touching the bottom wall.

An additional advantage of a package having one or two fourth fold lines is that the wall to which a bottom wall portion present between the fourth and an adjacent first fold line is secured, is given a larger rigidity. This may enable a less rigid packaging material to be used for the strip.

In lamps having comparatively small transverse dimensions, for example tubular lamps, and in lamps of current types it may be advantageous to start from an approximately double width strip and to package two lamps therein so that a twin pack is obtained. In the same manner, more than two lamps may be packaged in a proportionally wide strip possibly provided with tear-off lines. Such a multiple strip may be considered to be constructed from the relevant number of single strips which are combined laterally.

It is to be noted that U.S. Pat. No. 4,194,623 discloses a packaged electric lamp in which an elongated strip is bent around the end of the lamp remote from the lamp cap. In the two parts of the strip formed by bending, incisions are made on either side of the lamp so that edge portions and central portions are formed. Each edge portion is connected to the opposite edge portion. Furthermore, lugs are punched in both parts of the strip formed by bending so that the packaged lamp can be displayed in a standing position.

In the packaged lamp of the aforementioned U.S. patent, the central portion hides the packaged lamp from view both on the front side and on the rear side. Furthermore the package strip must be comparatively flexible, at least in the longitudinal direction, so as to be able to be bent around the lamp envelope. As a result of this the punched lugs are also comparatively flexible and when a lamp has been in a shipping package for a long time or has been put down frequently, the lugs may have lost their resilience. Furthermore, these lugs cannot exert a supporting function when a lamp is packaged whose lamp envelope tapers and their supporting function is insufficient in the case of tubular lamps the length of which is larger than the diameter. In both cases the lugs are too close together to ensure the stability of a standing packaged lamp. The known packaged lamp therefore does not satisfy the object of the present invention.

Figure 1B:
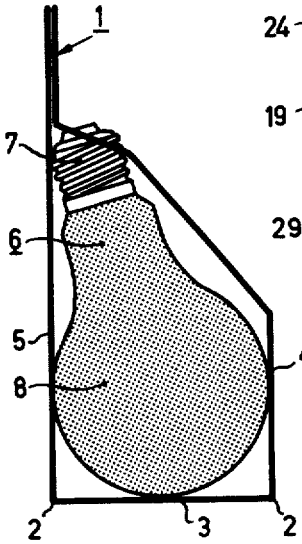
PRIOR ART FIG. 1b
Figure 2A:
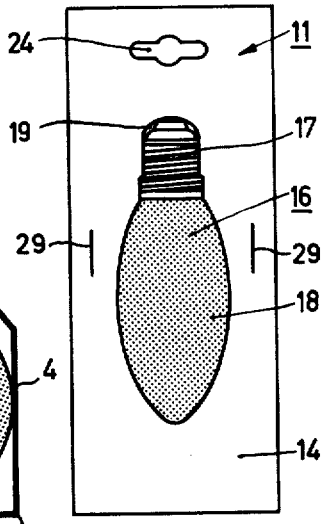
Figure 2B:
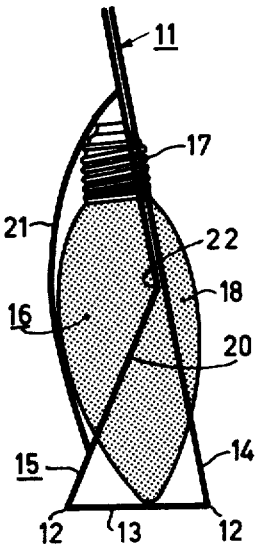
Figure 2C:
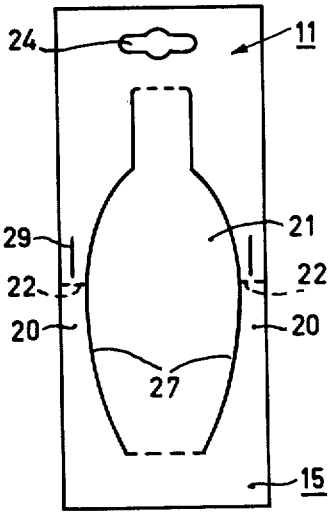
Figure 2D:
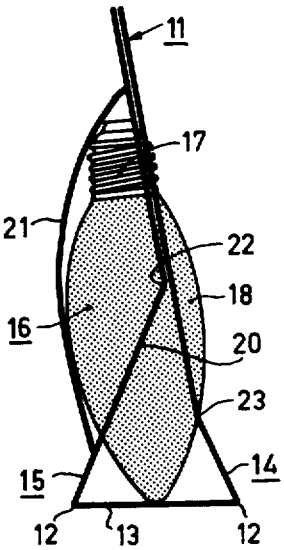
Figure 3A:
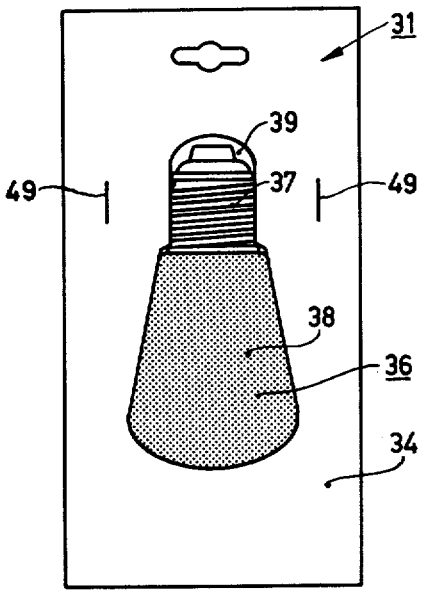
Figure 3B:
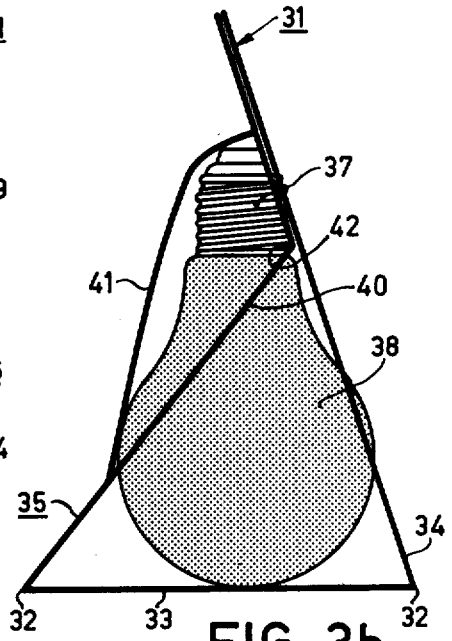
Figure 3C:
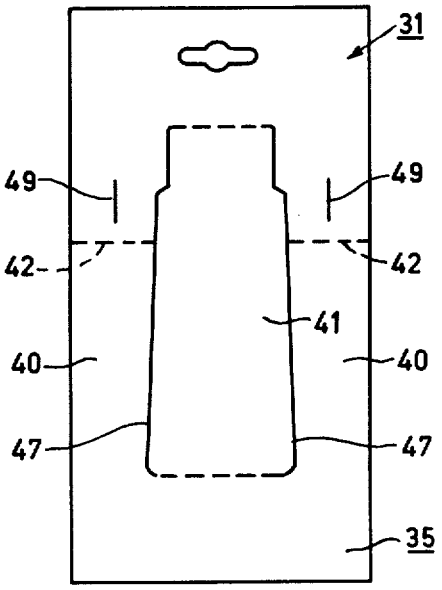
Figure 4A:
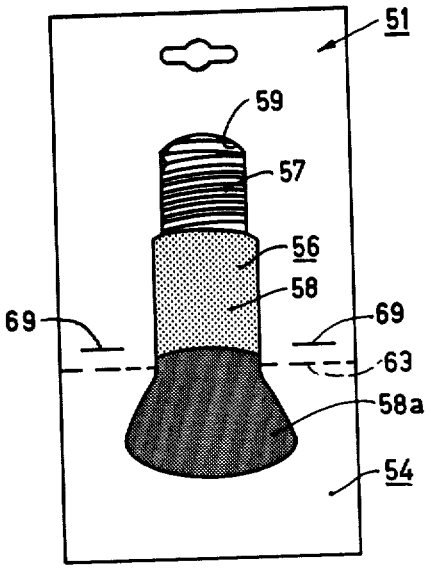
Figure 4B:
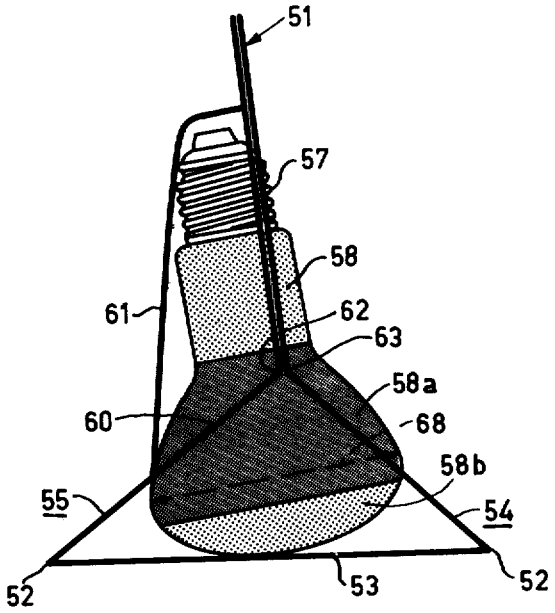
Figure 5A:
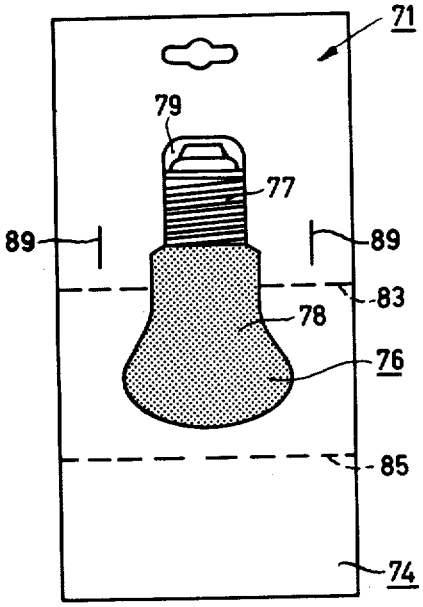
Figure 5B:
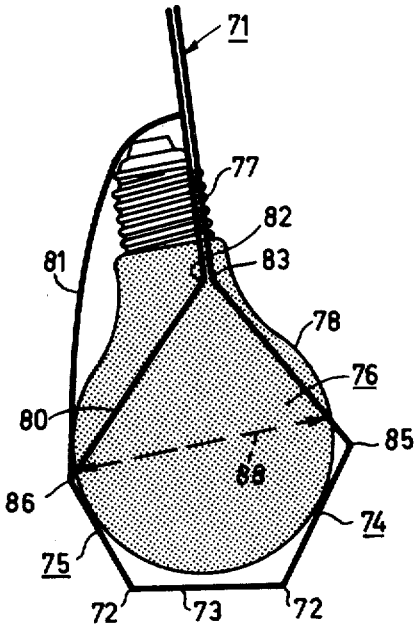
Figure 5C:
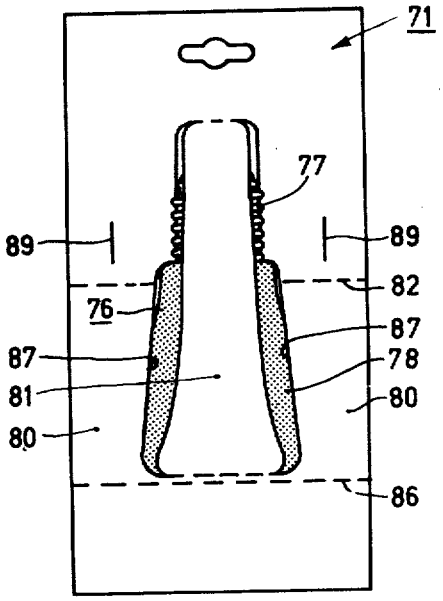
Figure 6A:
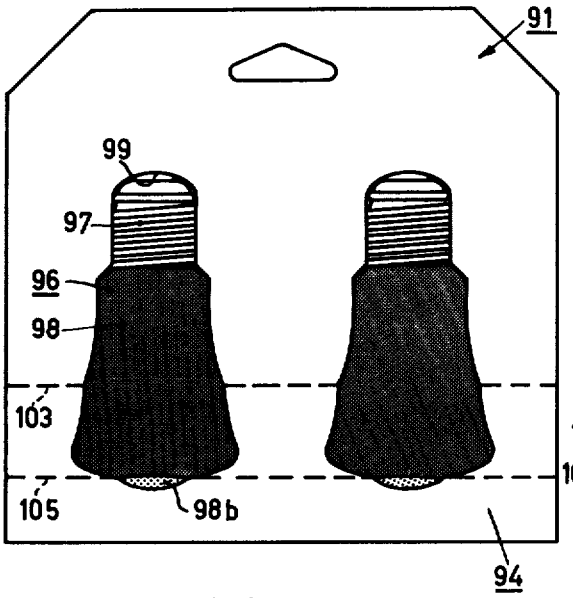
Figure 6B:
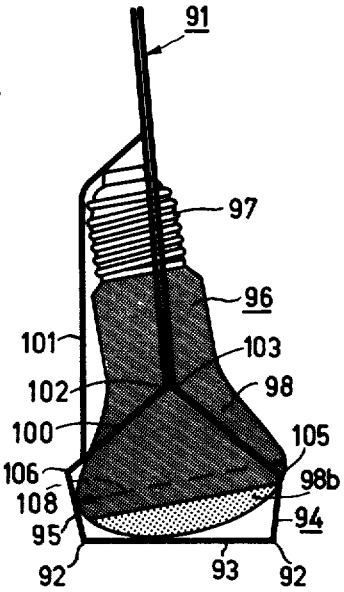
Figure 7:
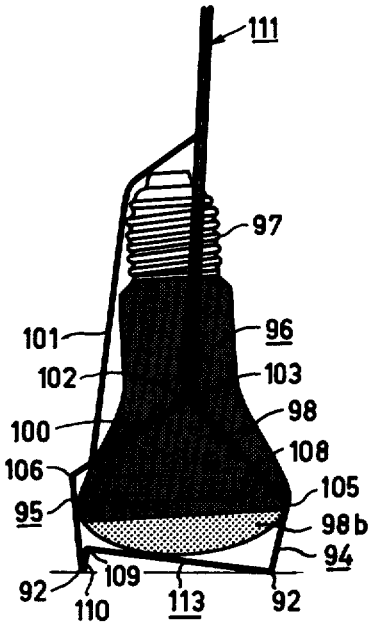
Figure 8:
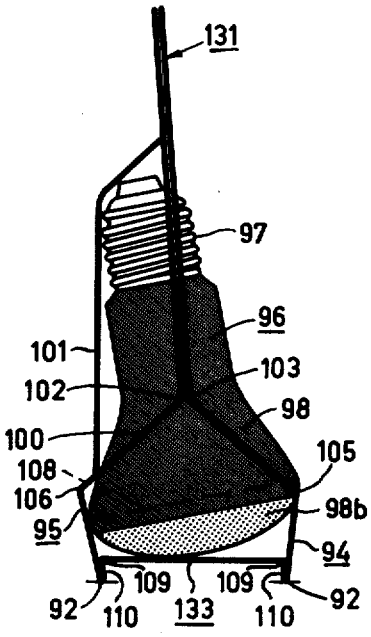

The invention will now be described in connection with the acompanying drawings, in which:

FIGS. 1*a* and 1*b* are a front elevation and a side elevation, respectively, of the packaged electric lamp according to the above-mentioned Canadian patent, FIGS. 2*a*, 2*b* and 2*c* are a front elevation, a side elevation and a rear elevation, respectively, of a first embodiment of the invention, FIG. 2*d* is a modified embodiment of FIG. 2*b*, FIGS. 3*a*, 3*b* and 3*c* are a front elevation, a side elevation and a rear elevation, respectively, of another lamp in a comparable embodiment, FIGS. 4*a* and 4*b* are a front elevation and a side elevation, respectively, of another embodiment, FIGS. 5*a*, 5*b* and 5*c* are a front elevation, a side elevation and a rear elevation, respectively, of a further embodiment, FIGS. 6*a* and 6*b* represent a modified embodiment of FIGS. 4*a* and 4*b* shown as a front elevation and a side elevation, and FIGS. 7 and 8 are side elevations of a modified embodiment of the packaged lamp shown in FIGS. 6*a* and 6*b*.

In FIGS. 1*a* and 1*b* a strip 1 of packaging material is folded about fold lines 2 so as to form a wall bottom 3, a front wall 4 and a rear wall 5 in accordance with the teaching of the aforementioned Canadian patent. The lamp 6 with lamp cap 7 and lamp envelope 8 is partially retained in the package by the window 9 through which only a part of the lamp cap projects. Without an adhesive layer on the inside, the strip 1 would hold the lamp 6 inadequately for practical use. The lamp 6 can be removed without destroying the strip 1. Viewed from the front this known packaged lamp displays only a very small part of the lamp.

In FIGS. *2a*, *2b* and *2c* an elongate strip 11 of duplex cardboard, weight 350 g/m$^2$, is folded about parallel transversal first fold lines 12 so as to form a bottom wall 13, a front wall 14 and a rear wall 15. The strip encloses a lamp 16 having a lamp cap 17 at one end of a lamp envelope 18, the lamp cap 17 being remote from the bottom wall 13. The front wall 14 has a window 19 which extends lengthwise from the lamp cap 17 along the lamp envelope 18 towards the bottom wall 13. A comparison of FIGS. *2a* and *2b* shows that the window 19 corresponds to the shape of the silhouette of the lamp 16. It shows the shape, colour and degree of transparency of the lamp envelope 18 and the nature and the size of the lamp cap 17. The window 19 engages the lamp 16 with its edges or boundary for the greater part. This prevents the lamp 16 from being removed from the strip through the window 19. Furthermore, the window also ensures (see FIG. *2b*) that the lamp 16 cannot be removed from the package laterally.

An incision 27 which extends to above the lamp cap 17 is made in the rear wall 15 on either side of the lamp 16 and extends substantially in the longitudinal direction of the strip. As a result of this, edge portions 20 are formed in the rear wall 15 which extend obliquely over the lamp envelope 18 (at an acute angle with respect to its axis) to the front wall 14 and are secured thereto. The connection point 29 is indicated as a staple rather than a layer of adhesive, for the sake of clarity in the drawings. The edge portions 20 form a fold 22 at the area where the portions 20 touch the front wall 14. The connection points 29 of the edge portions 20 to the front wall 14 are situated above said fold 22. The edge portions 20 laterally fix the lamp 16 in the strip 11.

As a result of the provision of the incisions 27 a central portion 21 is formed in the rear wall 15 between the edge portions 20, against which central portion the lamp envelope 18 and the lamp cap 17 bear. Said central portion 21 keeps the lamp 16 pressed against the window 19 and completes the fixing of the lamp 16 in the packaging strip 11. In spite of the pointed tip of the lamp envelope 18, the lamp can be displayed in a standing position or alternatively, due to the provision of a hole 24, in a suspended position.

In FIG. *2d* the lamp is shown leaning backwards at an angle with the vertical. A printed text on the front wall 14 as regards operating voltage and power of the lamp 16 is thus easily visible. By displacing the fold lines 12 the lamp 16, however, can be put down at a different angle. Notably in the case in which the lamp 16 is put down more vertically or even leaning forward, a second fold line 23 in the front wall 14 below the lamp cap 17 parallel to the first fold lines is of importance, about which the front wall 14 is bent concavely and obtains a concave outer surface. The distance between the fold lines 12 is thus increased, as is the size of the bottom wall 13.

In FIGS. *3a*, *3b* and *3c* a lamp 36 is packaged in a strip 31 of triplex cardboard, weight 400 g/m$^2$, folded about tranversal first fold lines 32 so as to form a bottom wall 33, a front wall 34 and a rear wall 35. On either side of the lamp 36 comprising lamp cap 37 and lamp envelope 38 in the rear wall 35 an incision 47 extending substantially in the longitudinal direction of the strip is made to form edge portions 40 which extend obliquely over the lamp to the front wall and are secured thereto at connection points 49. A central portion 41 locally engages the lamp 36 and presses same against a window 39 in the front wall 34. Where the edge portions 40 touch the front wall 34 a fold line 42 is provided for the relief of unwanted material stress. The edge portions 40 extend along the lamp envelope 38 with a small amount of play or bear against it laterally. The strip 31 ensures a good fixing for the lamp 36 in the package.

FIG. *3c* shows the packaged electric lamp from the rear. This view is identical to the front as well as the rear view of a packaged electric lamp according to the abovementioned U.S. patent in which the punched lugs have been omitted. In the packaged lamp of such U.S. patent, however, neither from the front nor from the rear can it be observed what kind of lamp has been packaged.

In FIGS. *4a* and *4b* a lamp 56 having a lamp cap 57 directed upwards and lamp envelope 58 is packaged in which the lamp envelope has a conical mirrored portion **58*a* and a satined window 58*b*. The strip 51 of mini-corrugated cardboard having a weight of 450 g/m$^2$ has a bottom wall 53 divided from a front wall 54 and a rear wall 55 by transversal first fold lines 52**.

The front wall 54 has a window 59 which extends from the lamp cap 57 along the lamp envelope 58 towards the bottom wall 53, and a second fold line 63 between the lamp cap 57 and the largest transverse dimension 68 of the lamp 56 parallel to the first fold lines 52. Longitudinal incisions are provided in the rear wall to form edge portions 60 and a central portion 61. The edge portions extend obliquely over the lamp envelope 58 towards the front wall 54 and extend from the fold 62 along said wall and are secured thereto at connection points 69.

The lamp 56 has such a shape that its largest transverse dimension 68 lies near the boundary between the mirrored portion **58*a* and the satined lamp envelope portion 58*b*, hence near the end of the lamp opposite the lamp cap 57**.

The front wall 54 is bent concavely about the second fold line 63 so that the window 59 engages a considerable part of the lamp 56 with its edges. The edge portions 60 also extend over the lamp envelope portion **58*a* towards the front wall 54 at a larger angle with respect to the axis of the lamp 56. Consequently, the lamp is already securely fixed by the parts of the strip 51 engaging around the lamp envelope portions 58*a* and 58*b* and the central portion 61 has a minor function in this respect. The window 59** gives a good indication of the nature and shape of the lamp.

A parabolic pressed glass lamp can also be packaged in such a strip.

FIGS. *5a*, *5b* and *5c* can be compared with FIGS. *3a*, *3b* and *3c*, respectively. Corresponding parts are referred to by reference numerals which are 40 higher than those of FIGS. *3a*, *3b* and *3c*.

In FIGS. *5a* and *5b* a second fold line 83 is present parallel to the first fold lines 72 and between the lamp cap 77 and the largest transverse dimension 88 of the lamp envelope 78, about which line the front wall 74 is bent concavely. The largest transverse dimension 88 of the lamp envelope 78 is situated more towards the end opposite the lamp cap 77. The bend about the second fold line 83 ensures that the window 79 in FIGS. *5a* and 5*b* extends with its edges to a greater extent over the lamp envelope 78 and even over the lamp cap 77. The front wall 74 near the second fold line 83 is brought more towards the rear as a result of which the rear wall 75 with its edge portions or strips 80 comes near the front wall 74 at a lower place 82. The edge strips 80 also extend over the lamp envelope 78 at a larger angle with respect to the longitudinal direction of the lamp 76. The result is not only a decrease in volume of the packaged lamp but also an even better retention of the lamp 76 in the strip 71.

Third fold lines 85 and 86, respectively, are provided in the front wall 74 and in the rear wall 75 parallel to the first fold lines 72 near the largest transverse dimension 88 of the lamp envelope 78, about which said walls are bent convexly. In the embodiment shown the lamp envelope 78 bears against the portions of the front wall 74 and the rear wall 75, respectively, situated below said third fold lines 85 and 86. The bottom wall 73 is present at a distance from the lamp envelope 78 and thus constitutes an extra shock absorber. The volume of the packaged lamp is smaller also as a result of the third fold lines 85 and 86.

FIG. 5*c* shows that the edge strips 80 which are formed by the incisions 87 engage the lamp envelope 78 laterally. In the embodiment shown, a part of the central portion or strip 81 resulting from the incisions 87 is removed along its free edges so that a small part of the lamp 76 is seen also on the rear side of the packaged lamp.

FIGS. 6*a* and 6*b* are comparable to FIGS. 4*a* and 4*b* and corresponding parts have reference numerals which are 40 higher than those of FIGS. 4*a* and 4*b*. The lamp 96 has a powder-coated lamp envelope 98 with a satined window 98*b*. In this lamp also the largest transverse dimension 108 is present near the end opposite the lamp cap 97. In the front wall 94 and in the rear wall 95, third fold lines 105 and 106, respectively, are present parallel to the first fold lines 92 about which said walls are bent convexly. Said fold lines 105 and 106 are present near the largest transverse dimension 108 of the lamp 96 below and above, respectively, said transverse dimension 108. It will be clear that said position depends inter alia upon the inclination of the lamp 96 in the strip 91.

The packaged lamp is shown in a twin pack which may be considered to be built up from two single packages combined laterally.

Comparison of FIG. 6*b* with FIG. 4*b* shows a reduction in overall volume and a saving of material as a result of the third fold lines.

In FIGS. 7 and 8, components which correspond to those of FIG. 6*b* are referred to by the same reference numerals.

In FIG. 7 the strip 111 is folded about transversal first fold lines 92 so as to form a bottom wall 113, a front wall 94 and a rear wall 95. A fourth fold line 109 is provided in the bottom wall 113 near the first fold line 92, about which fourth fold line 109 the bottom wall 113 is bent concavely. The bottom wall portion 110 which is present between the fourth fold line 109 and the adjacent first fold line 92 is connected to the rear wall 95 on the other side of said first fold line 92.

In a corresponding manner the strip 131 in FIG. 8 is provided with two fourth fold lines 109 in the bottom wall 133 about which fourth fold lines 109 the bottom wall 113 is bent concavely.

Whereas the position of the lamp 96 in the strip 131 is equal to that in the strip 91 of FIG. 6*b*, the lamp 96 in strip 111 of FIG. 7 leans more forward. By moving the first fold lines 92 more towards the rear wall 95, however, the same position can be achieved with the FIG. 7 embodiment.

Both the packaged lamp embodiment of FIG. 7 and that of FIG. 8 are particularly stable in a two-line contact with the supporting surface, also when the lamp slightly indents the bottoms 113 and 133, respectively, while in FIG. 7 the rear wall 95 and in FIG. 8 the rear wall 95 and the front wall 94 have obtained an extra rigidity. The concavely bent raised bottom walls 113 and 133, respectively, give the packaged lamps in addition a substantial resistance to impact.

In FIGS. 6*a*, 6*b*, 7 and 8 the part of the front wall 94 above the second fold line 103 is connected by means of adhesive to the part of the rear wall 95 above the bend 102 in the edge strip 100.

The packaged lamp of the invention cannot be removed from the package without destroying same but in spite of this the lamp can be easily seen in the package when viewed from the front.

What is claimed is:

1. An electric lamp package, which comprises a lamp envelope connected at one end to a lamp cap; an elongate packaging strip folded along parallel transversal first fold lines to form a bottom wall, a front wall and a rear wall for accommodating the lamp with its lamp cap remote from the bottom wall, the front wall and the rear wall extending above the lamp cap and engaging each other; a lengthwise extending opening formed in the front wall to provide a window for displaying at least part of the lamp cap and a part of the lamp envelope, the boundary of said opening engaging the lamp to hold the same in place; a pair of lengthwise incisions formed in the rear wall and extending beyond the lamp cap to provide two edge portions in opposite lateral edge-wise contact with the lamp envelope; and means to secure the respective edge portions to the front wall.

2. An electric lamp package according to claim 1, in which the front wall has a second fold line below the lamp cap and parallel to the first fold lines, the front wall being bent concavely about said second fold line.

3. An electric lamp package according to claim 2, in which the largest transverse dimension of the lamp envelope is situated nearer to the end of the lamp opposite the lamp cap, the second fold line being between the lamp cap and said largest transverse dimension.

4. An electric lamp package according to claim 3, in which the front wall has a third fold line below the second fold line and parallel to the first fold lines, the front wall being bent convexly about said third fold line.

5. An electric lamp package according to claim 4, in which the rear wall has a third fold line below the lamp cap and parallel to the first fold lines, the rear wall being bent convexly about its third fold line.

6. An electric lamp package according to claim 5, in which the front wall and the rear wall engage the lamp envelope below the respective third fold lines.

7. An electric lamp package according to claim 6, in which the lamp envelope is spaced from the bottom wall.

8. An electric lamp package according to claim 6, in which the bottom wall has a fourth fold line near one of the first fold lines and parallel thereto, the bottom wall being bent concavely about said fourth fold line, and in which the bottom wall portion between the fourth fold line and the adjacent first fold line is connected to the wall on the other side of said first fold line.

9. An electric lamp package according to claim 8, in which the bottom wall has another fourth fold line near the other first fold line, the bottom wall being bent concavely about said other fourth fold line, and in which the bottom wall portion between the other fourth fold line and its adjacent first fold line is connected to the wall on the other side of said adjacent first fold line.

* * * * *